US005482672A

United States Patent [19]

Friedman et al.

[11] Patent Number: 5,482,672

[45] Date of Patent: Jan. 9, 1996

[54] PROCESS FOR EXTRUDING TANTALUM AND/OR NIOBIUM

[76] Inventors: Ira Friedman, 10 Bingham Hill Cir., Rumson, N.J. 07760; Christer Aslund, Bravallavagen 11 644 36, Torshalla, Sweden

[21] Appl. No.: 386,065

[22] Filed: Feb. 9, 1995

[51] Int. Cl.[6] ..... B22F 3/12; B22F 3/16

[52] U.S. Cl. ..... 419/42; 419/28; 419/30; 419/38

[58] Field of Search ..... 419/28, 30, 38, 419/42

[56] References Cited

U.S. PATENT DOCUMENTS

| | | | |
|---|---|---|---|
| 3,922,769 | 12/1975 | Brenan | 29/420.5 |
| 4,050,143 | 9/1977 | Aslund | 29/420.5 |
| 4,143,208 | 3/1979 | Aslund | 428/558 |
| 4,150,196 | 4/1979 | Aslund | 428/558 |
| 4,373,012 | 2/1983 | Aslund et al. | 428/558 |
| 4,401,723 | 8/1983 | Aslund et al. | 428/554 |
| 4,486,385 | 12/1984 | Aslund | 419/48 |
| 4,923,671 | 5/1990 | Aslund | 419/8 |
| 4,966,748 | 10/1990 | Miyasaka et al. | 419/8 |
| 5,242,481 | 9/1993 | Kumar | 75/364 |
| 5,445,787 | 8/1995 | Friedman | 419/38 |

*Primary Examiner*—Donald P. Walsh
*Assistant Examiner*—Scott T. Bluni
*Attorney, Agent, or Firm*—Francis C. Hand; McAulay Fisher Nissen Goldberg & Kiel

[57] ABSTRACT

The process for extruding tantalum or niobium includes sealing a cold isostatically pressed charge of tantalum or niobium powder in a first metal cylinder and then sealing the first cylinder in a second metal cylinder with a metal powder of spherical shape in a gap between the cylinders. Thereafter, the second cylinder is cold isostatically pressed to prevent the metal powder in the gap from segregating. This is followed by heating and extrusion of the second container to form, e.g. an extruded bar. The ends of the bar and the skin on the bar can be removed to obtain a rod of tantalum (or niobium) with a yield of from 95% to 96% of the original powder.

20 Claims, 1 Drawing Sheet

PROCESS FOR EXTRUDING TANTALUM AND/OR NIOBIUM

This invention relates to a process for extruding tantalum and/or niobium.

BACKGROUND

Hot extrusion of metal powder is a feasible technique to consolidate metal powders to fully dense products. Extrusion offers distinct advantages for long products like bars, rods, tubes and profiles not only because of high yields but also because "difficult to make" metals can be produced directly to a certain shape.

The specific deformation pattern characterized by hot extrusion also tends to break up surface films, such as oxides and other impurities on the powders, thereby giving a much better quality to the finished product.

Refractory metals, such as tantalum and niobium and their alloys can be extruded. However, one of the characteristics of these metals is that their raw material cost is extremely high. This makes it very important to optimize the yield in each operation. In the case of extrusion, it is important to minimize the losses caused by imperfections and especially also to minimize losses in the front and back ends of the extrusion body. As described below, a normal appearance of an extruded billet from a solid material is shown in FIG. 2 and the same for a powder billet is shown in FIG. 4. The total product yield after extrusion is very seldom over 85% for a powder capsule and seldom over 90% for a solid material. The reasons for the lower yield for the powder billet is that a front plate is drawn over the powder at extrusion and a back end plate is sucked into the powder at the other end.

Tantalum powder can be made from tantalum solid metal which is hydrided, crushed, and dehydrided to powder form or produced from potassium tantalum fluoride by sodium reduction or by other means. This irregular powder is then pressed to a small bar which is sintered in vacuum at a high temperature to form a rod which is then processed in several steps down to finer dimensions, for example, through cold rolling. Alternatively, tantalum is electron beam melted or arc cast melted to produce ingots which are processed into rod, sheet or tubing, for example, by forging, swaging, rolling, etc.

In powder form, tantalum picks up oxygen at the hydriding, dehydriding and melting stages, Subsequent sintering in vacuum is also a refining step where not only oxygen but also other impurities are removed as a result of high temperature and a high vacuum. Tantalum forms extremely stable oxides. High purity, low oxygen tantalum powder which is exposed to air, even at room temperature, can be a safety risk; the finer the powder is, the higher the risk.

The conventional way of processing tantalum is a very costly process. Not only the many process steps but also production of the rod, sheet or tubing provide low product yield which affect the final production costs dramatically.

As described in copending patent application Ser. No. 08/146,788, filed Nov. 2, 1993, now U.S. Pat. No. 5,445,787, it has also been known to form an extruded product of a powder charge of tantalum or niobium in a process in which a charge of the powdered metal is subjected to a sequence of cold isostatic pressing steps and heating steps prior to extruding the compressed charge. Typically, the powdered metal is first compressed into a green compact or billet which is then placed in a capsule of carbon steel and heated to an annealing temperature. Thereafter, the capsule is again cold isostatically pressed and then heated and extruded into an extruded product.

However, even in this case, it is extremely difficult to increase the yield from the powder in the billet to the extruded product to more than 85%. Even if this is a normal yield and far higher than the yield obtained in a conventional process to produce tantalum, it is of important economical value to reach as high a yield as possible.

Furthermore, during the final cold isostatic pressing of the metal capsule, there is always a risk of a leakage when a water emulsion subjects the powder billet to a pressure of up to 500 MPa (75,000 psi). In such a case, the water represents a risk during the following heating of the billet. That is to say, the water which has penetrated the billet can transform into steam during heating and create an explosive situation. There are techniques to detect such water but if the water-extrusion penetrates the tantalum powder, the powder is in principle destroyed and must be scrapped. A normal yield loss in cold isostatic pressing is between 1–5%, thus, further decreasing the efficiency of the process.

One way to ensure that no water exists during the final heating before extrusion is to vacuum pump the billet, preferably under combined vacuum and heat.

Accordingly, it is an object of the invention to be able to produce products made of tantalum and/or niobium at a relatively low cost and with a high density.

It is another object of the invention to provide a relatively simple technique for extruding tantalum and niobium powders into extruded products of high density.

It is another object of the invention to provide an improved method of forming high density tantalum and niobium products.

Briefly, the invention provides a process of forming extruded products of tantalum and/or niobium.

In accordance with the process, a charge of powdered metal selected from the group consisting of tantalum and niobium is cold isostatically pressed to a density sufficient to form a green compact or billet with a sufficient strength to be handled. Preferably, the compressed billet of tantalum is made by the known so-called wet bag process. The cold isostatic pressure is chosen so that the obtained density is between 70–85% of the theoretical density. The compressed billet is then released from the wet bag and placed in a container or capsule which is then sealed with end caps by welding. The material of this container could consist of carbon steel or of tantalum or niobium, i.e. the same material as the compressed powder billet.

The carbon steel used, could typically be of low carbon content to avoid segregation during the following heating. For example, such carbon content could be less than 0.005% and typically in the range of 0.002– 0.003%. With such low carbon content, carbon pick up is avoided, for example, into the tantalum, which is very sensitive even for small amounts of impurities like carbon.

In the process described in application Ser. No. 08/146,788, if a wet bag operation is made and the compressed powder billet is placed in a metal container, a second heating operation is necessary before the second cold isostatic pressing reaches a sufficiently good extrusion result. The commonly accepted reason is that in order to extrude thin-walled capsules, the density of the powder must be approximately a minimum of 80% of the theoretical density to avoid wrinkling of the capsule thereby causing imperfections.

In accordance with the invention, the wet bag compressed billet is placed in a metal container with narrow tolerances between the billet and the container. No annealing is made but other operations can be done, for example, in the case of tantalum, evacuation of the container or dehydriding of the tantalum powder can be performed while subjecting the tantalum in the container to a vacuum at moderate temperature (600° to 1000° C.).

The metal container is then placed in a second metal container with an annular gap between the two containers. This gap is filled with a carbon steel powder or another type of metal produced with a spherical shape which gives a high filling density after vibration, i.e. approximately 70%, and with a yield strength (flow stress) substantially lower than the enclosed tantalum or niobium at the extrusion temperature.

It is important before filling to place the inner metal container concentrically in the outer container in order to ensure a satisfactory extrusion result. Accordingly, spacers may be provided to maintain an annular gap between the containers.

This double container is then sealed, for example, using end caps, and cold isostatically pressed in order to avoid segregation of the metal powder in the cap between the containers during the subsequent handling before extrusion. The isostatic pressing may be performed at a pressure of at least 200 mpa for this purpose. As the tantalum or niobium powder is already cold isostatically pressed once, the density of this material will not be affected. The hardness of the carbon steel is (in the atomized condition) so high that the density of this surrounding material, also after cold isostatic pressing, is increased very little to just slightly over 70%.

Thereafter, the compressed double container is heated and extruded to form an extruded product, for example, of bar shape. Typically, the front and rear ends of the bar are primarily made of the material of the end caps which serve to seal the containers and the compacted powder in the outer container. Hence, the front and rear ends of the extruded product can be cut off and removed leaving a bar which is primarily made of tantalum or niobium, as the case may be. Typically, the extruded rod at this point has a yield of from 93% to 96% of the beginning powder.

These and other objects and advantages of the invention will become more apparently from the following detailed description taken in conjunction with the accompany drawings wherein.

Figure 1:
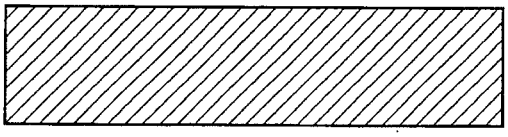
FIG. 1 Prior Art
FIG. 1 illustrates a side view of a solid billet, for example, of wrought metal prior to extrusion in a conventional extrusion process.
Figure 2:
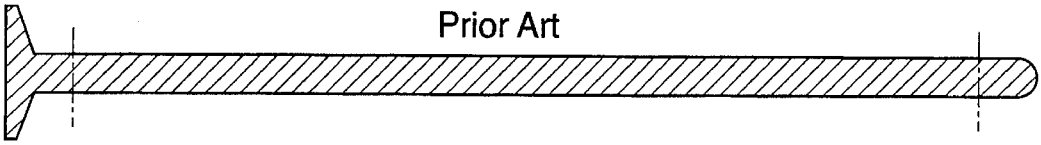
FIG. 2 Prior Art
FIG. 2 illustrates a view of an extruded rod made from the solid billet of FIG. 1 in accordance with known techniques.

Referring to FIGS. 1 and 2, it has been known that a solid billet 10 of wrought metal, such as tantalum, may be extruded in to an extruded bar 11 using conventional extrusion techniques. As indicated, the front end of the extruded bar 11 has a rounded shape due to the extrusion process while the rear end has an enlarged shape. Typically, the ends are cut off and removed so that the yield in the conventional extrusion process is between 85% and 92% of the original billet 10.

Figure 3:
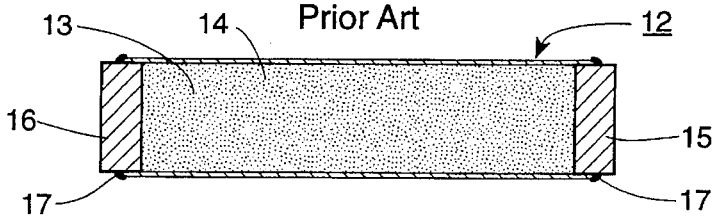
FIG. 3 Prior Art
FIG. 3 illustrates a cross-sectional view of a powder billet in accordance with the prior art prior to extrusion.
Figure 4:
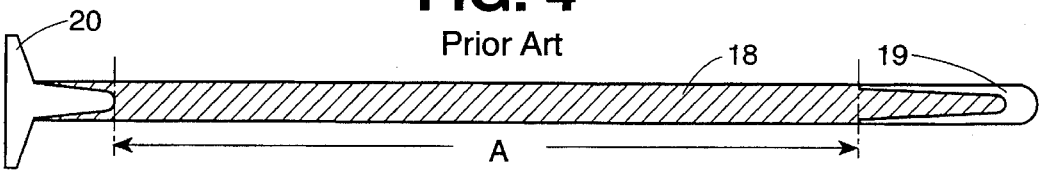
FIG. 4 Prior Art
FIG. 4 illustrates a rod extruded from the powder billet of FIG. 3 in accordance with known techniques.

Referring to FIGS. 3 and 4, the conventional powder billet 12 is formed of a cylindrical container 13, for example, of carbon steel which is filled with powder 14, such as a tantalum powder and which is sealed at the respective ends by two plates 15, 16, each of which is welded as by welds 17 to the end of the container 13. The resulting billet 12 is then extruded using known techniques so as to form an extruded rod 18 as indicated in FIG. 4.

Referring to FIG. 4, the extruded rod 18 typically has a front end 19 which is formed primarily by the metal of the front plate 15 of the billet 12 while the rear end 20 is formed primarily of the metal of the back plate 16. As in FIG. 2, the rear end of the extruded rod 18 is typically enlarged as this is a part which remains after pressing in an extrusion press. As in the previous technique, the front end and rear end of the extruded rod 18 are cut off and discarded so that only the central portion A which is formed of consolidated powder is used as the extruded product. In this technique the yield is usually between 83% and 88% of the original powder charge.

Figure 5:
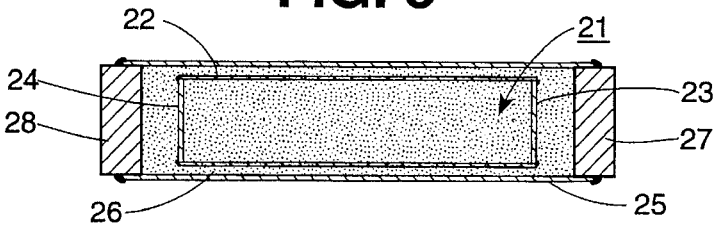
FIG. 5 illustrates a cross-sectional view of a double container formed in accordance with the invention.
Figure 6:
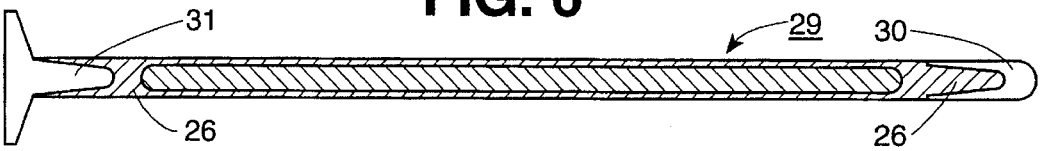
FIG. 6 illustrates a view of an extruded product in accordance with the invention.

Referring to FIGS. 5 and 6, in accordance with the invention, an extrusion process is performed which is able to obtain a high yield, for example, in a range of from 93% to 96% of the original powder charge.

By way of example, a charge of tantalum powder (e.g. tantalum hydride) is cold isostatically pressed using the wet bag process to form a billet 21 of 102 mm diameter and a length of 500 mm. The billet 21 was then placed in a container 22 of cylinder shape and of low carbon steel with tight tolerances. The billet 21 had a density of 72% of the theoretical density.

The container 22 was then sealed by securing end caps 23, 24 of metal-at each end and placed in another container 25 with a diameter of 126 mm and with a wall thickness of 2 mm. The two containers 22, 25 were spaced apart, e.g. by spacers (not shown), to maintain an annular gap between the two containers of approximately 10 mm. The gap was then filled with a carbon steel powder 26 with a carbon content of 0.85% by weight. The carbon steel powder 26 was atomized with high hardness and was spherical in shape. The filling density of this surrounding powder was 68%.

The outer container 25 was then sealed by securing metal front and back plates 27, 28 to the cylinder 25, as by welding.

Next, the sealed container 25 was subjected to a cold isostatic pressure of 435 MPa (approximately 65,000 psi). In spite of this high pressure, the density of the carbon steel only increased to 75%. After this cold isostatic pressing, a hole was drilled in one of the end plates 27, 28 which gave access to the surrounding carbon steel powder 26. This powder was then checked for leakage, eliminating the need for testing and exposing the tantalum 21 to air. No water was detected and the hole was closed again.

The container 25 was then heated at a temperature of 1,200° C. and extruded as a force of 1,350 tons to a bar 29 of 42 mm diameter.

Referring to FIG. 6, the extruded bar 29, as is conventional, has a rounded shape at the front end 30 and an enlarged shape at the rear end 31. In addition, the front end 30 is formed primarily of the metal of the front plate 27 secured to the container 25 mixed with the compacted carbon steel powder while the rear end 31 is formed primarily of the metal of the back plate 28 mixed with the compacted carbon steel powder. In addition, the front end 30 has a section which is primarily formed of the consolidated carbon steel powder. This is followed by the consolidated tantalum powder 26. Likewise, the rear end 31 has a section of consolidated carbon steel powder 26 between the enlarged rear end 31 and the rear end of the consolidated tantalum powder.

In accordance with the invention, the front end and rear end of the extruded bar 29 can be cut off at points so as to produce an elongated rod of tantalum which has a yield of from 93% to 96% of the original powdered tantalum product.

The extruded rod of the tantalum also has a "skin" which is formed of the outer container 25, the consolidated carbon steel powder 26 and the inner container 22. This "skin" can be removed using any suitable conventional technique.

After removal of the carbon steel consolidated powder 26 surrounding the extruded tantalum, which can be done by machining, pickling or mechanical means, it was found that the extruded tantalum had an excellent surface in spite of the low density of the container 25 before extrusion. Apparently, the carbon steel 26 functioned as a lubricant during extrusion and prevented the carbon steel container 22 surrounding the extruded tantalum from wrinkling. Note was also made that the outer carbon steel container 25 surrounding the carbon steel powder 26 had wrinkled here and there during extrusion but this surface problem had not been transferred to the inner container 22.

In another case, water was found in the carbon steel powder 26 between the containers 22, 25 after the cold isostatic pressing. In this case, the container 25 and the powder 26 were removed and replaced with a new outer container and with new carbon steel powder and cold isostatically pressured again. Through this operation, the extremely expensive tantalum powder could be saved and only the inexpensive carbon steel powder needed to be replaced. In this case, it is possible but extremely unlikely that water had also penetrated the tantalum billet 21. Hence, there was no need for this billet to be checked for water.

Another surprising result of this double container was that the extrusion force was substantially lower than the extrusion force of 1,800 tons when extruding a full container of tantalum. It is possible to calculate the theoretical extrusion force for a combined billet of two materials by considering their respective hot strength relative to their cross section at extrusion. It was here found that the flow stress of the double container with the two powders had a flow stress at extrusion temperature approximately 20% lower than what could be expected. This helps to extrude thinner sections or bigger billets as the extrusion force is a limiting factor for tantalum.

Another factor of importance is the fact that the double container can be optimized in shape to give a high product yield of tantalum. A yield of approximately 95% of product (see FIG. 6) and a yield of 98% of material can be obtained. This is of course very important when dealing with extremely expensive materials like tantalum.

As a summary, the result of using the double container obtains several advantages when used on materials like tantalum or niobium. First, there is no need to make an intermediate anneal after the wet bag operation. Also, the material can be extruded to a good product without surface defects.

Second, the container can be safely inspected for water after the second cold isostatic pressing while saving the expensive tantalum if leakage occurs. It is extremely unlikely that both containers leak at the same time.

Third, unexpectedly, the flow stress is lower than expected for the double container giving the possibility to extrude thinner dimensions safely.

Fourth, a higher product yield can be obtained.

What is claimed is:

1. A process comprising the steps of cold isostatically pressing a charge of powdered metal selected from the group consisting of tantalum and niobium to a density sufficient to form a billet with sufficient strength to be handled;

placing the billet in a first metal container;

thereafter sealing the container;

placing the container in a second metal container with an annular gap defined between said containers;

filling said gap with a metal powder having a spherical shape;

thereafter sealing said second container;

thereafter cold isostatically pressing said second container and encapsulated billet at a predetermined pressure of at least 200 Mpa;

heating the compressed second container and encapsulated compact; and extruding the heated capsule and encapsulated compact to form an extruded product.

2. A process as set for in claim 1 wherein the second container is cold isostatically pressed at a pressure of 435 Mpa.

3. A process as set forth in claim 1 wherein the charge of powdered metal is cold isostatically pressed at a pressure sufficient to achieve a density of from 70% to 85% of theoretical density.

4. A process as set forth in claim 1 wherein the first container and encapsulated billet are subjected to a vacuum to remove air therefrom.

5. A process as set forth in claim 1 wherein the metal powder in said gap is a carbon steel powder with a carbon content of 0.85% by weight.

6. A process as set forth in claim 1 which further comprises the step of testing the metal powder in said gap for water after said cold isostatic pressing of said second and prior to said heating step.

7. A process as set forth in claim 1 wherein the extruded product is of bar shape.

8. A process as set forth in claim 1 wherein the extruded product has an outer layer of metal different in composition from the remainder of the product and which further comprises the step of removing said outer layer.

9. A process as set forth in claim 8 wherein the second container is made of carbon steel and said step of removing said layer of carbon steel from the extruded product includes pickling of the extruded product to remove said carbon steel layer.

10. A process as set forth in claim 1 wherein said powdered metal is tantalum in the form of a tantalum hydride.

11. A process as set forth in claim 10 which further comprises the step of evacuating hydrogen from the first container during sealing thereof.

12. A process as set forth in claim 1 wherein said second container is cylindrical and wherein said step of sealing said second container includes securing a first metal plate across a front end of said second container and a second metal plate across a rear end of said second container.

13. A process as set forth in claim 12 wherein the extruded product has a forward end formed primarily of the metal of said first plate and the metal powder in said gap and a rear end formed primarily of the metal of said second plate and the metal powder in said gap, said method further comprising the steps of removing said forward end and said rear end of the extruded product to obtain a consolidated product having a yield of from 93% to 96%.

14. A process comprising the steps of cold isostatically pressing a charge of tantalum powder to a density of 72% of theoretical density;

sealing the compressed charge in a first metal container;

sealing the first container in a second container with a metal powder having a spherical shape disposed in an annular gap between said containers;

thereafter cold isostatically pressing the second container and encapsulated compressed charge at a predetermined pressure of at least 200 Mpa; and heating and extruding the second container and encapsulated compressed charge to form an extruded product.

15. A process as set forth in claim 14 wherein the second container is heated to a temperature of 1,200° C. after said isostatic pressing thereof.

16. A process as set forth in claim 14 wherein the second container is isostatically pressed at a pressure of 435 MPa.

17. A process as set forth in claim 14 which further comprises the step of venting said gap between said containers after said step of isostatically pressing the second container to eliminate water vapor from said gap and the metal powder therein.

18. A process as set forth in claim 14 wherein said first capsule is made of low carbon steel.

19. An extruded product made in accordance with the process of claim 1.

20. An extruded product made in accordance with the process of claim 14.

* * * * *